United States Patent [19]

Ducote et al.

[11] Patent Number: 4,493,741

[45] Date of Patent: Jan. 15, 1985

[54] AMINE SALTS AS BONDING AGENTS

[75] Inventors: Marjorie E. Ducote, Huntsville; Henry C. Allen, Decatur, both of Ala.

[73] Assignee: The United States of America as represented by the Secretary of the Army, Washington, D.C.

[21] Appl. No.: 488,249

[22] Filed: Apr. 25, 1983

[51] Int. Cl.[3] ..... C06B 45/10

[52] U.S. Cl. ..... 149/19.4; 149/19.9; 149/20

[58] Field of Search ..... 149/19.4, 19.9, 20

[56] References Cited

U.S. PATENT DOCUMENTS 4,000,023 12/1976 Oberth et al. ..... 149/19.4

*Primary Examiner*—Edward A. Miller

*Attorney, Agent, or Firm*—Anthony T. Lane; Robert P. Gibson; Jack W. Voigt

[57] ABSTRACT

The polyamine compound, TEPAN, a partially cyanoethylated tetraethylene pentamine, is reacted with a selected ammonium salt to form an adduct of TEPAN and the selected ammonium salt. The ammonium salt is selected from ammonium perchlorate (AP), ammonium nitrate (AN), ammonium sulfate (AS), and ammonium formate (AF). The process for preparation of the adduct comprises reacting a water solution of the selected ammonium salt with TEPAN while stirring at room temperature. A TEPAN-glycidol derivative product is also reacted with the selected oxidizer salt to form an adduct of the TEPAN-glycidol derivative product.

The disclosed adducts (having adduct ratios of 1.0 to 1.8 equivalents of ammonium salt per mole of TEPAN or TEPAN-glycidol derivative product, TEPANOL) improve mechanical properties and processiblity of composite propellant composition containing about 88 weight percent solids (ammonium perchlorate, aluminum, and $Fe_2O_3$ catalyst), a binder of hydroxy-terminated polybutadiene and dioctyladipate cured with a mixture of isophorone diisocyanate and a trifunctional isocyanate.

Mechanical properties, especially strain at maximum stress at −40° C. are substantially improved. The processing time, particularly the mix cycle time, is shortened because of the amine salt bonding agent eliminating or minimizing in situ ammonia generation during the incorporation and mixing of ammonium perchorate into the propellant mix.

10 Claims, No Drawings

AMINE SALTS AS BONDING AGENTS

DEDICATORY CLAUSE

The invention described herein may be manufactured, used, and licensed by or for the Government for governmental purposes without the payment to us of any royalties thereon.

BACKGROUND OF THE INVENTION

A bonding agent system, such as those disclosed in our assigned U.S. Pat. No. 4,090,983, including MT4 (reaction product of 2.0 moles of tris 1(2 methylaziridinyl)phosphine oxide, 0.7 mole adipic acid, and 0.3 mole tartaric acid), HX752 (bis isophthaloyl 1(2 methyl) aziridine), and BIDE (butyliminodiethanol) in combinations of 0.10% to 0.20%, 0.10% to 0.20%, and 0.02% to 0.05% weight percent range respectively of a hydroxy-terminated polybutadiene propellant composition achieves improved propellant aging and low temperature physical properties. Other bonding agents such as BA114, the reaction product of equimolar quantities of 12-hydroxystearic acid and tris[1-(2-methylazirdinyl)] phosphine oxide, have also imparted very desirable mechanical properties to composite propellants.

Other types of compounds including certain amine compounds such as TEPAN, partially cyanoethylated tetraethylene pentamine, have long been used in the propellant industry as bonding agents in composite propellants containing ammonium perchlorate (AP). They greatly improve the mechanical properties of such propellants by chemically bonding AP particles to the binder matrix. TEPAN is also known to facilitate processing relative to other bonding agents since the mix viscosity of the propellant is not increased as much by TEPAN as it is by most other bonding agents. The disadvantage of using amine bonding agents is that ammonia is liberated during the mix and cure cycles due to displacement of ammonia from AP by amine groups in the bonding agent. The amine-ammonium perchlorate reaction requires subsequent ammonia removal from the mix because any residual ammonia will consume part of the isocyanate curing agent and thus interfere with propellant cure. If the amine-AP reaction and removal of ammonia is not substantially complete before addition of the curing agent to the propellant mix then soft cures and non-reproducible mechanical properties will result. A long mix/purge cycle is currently required to accomplish substantially complete ammonia removal. A substantial savings would be realized in man hours and equipment turn-around time, and greater reproducibility of propellants properties from mix to mix should result, if this mix time could be reduced.

Therefore an object of this invention is to provide adducts of TEPAN which function as amine salt bonding agents with ammonium perchlorate (AP) while eliminating or minimizing generation of ammonia when incorporated into the mix during the propellant mixing cycle.

A further object of this invention is to provide amine salt bonding agents which reduce the mixing cycle time and which improve the mechanical properties of the finished propellant.

Still a further object of this invention is to provide amine salt bonding agents which are prepared by prereacting an amine bonding agent with an ammonium salt to yield amine salt bonding agents which minimize in situ ammonia generation during the mixing and cure cycles of propellant processing.

SUMMARY OF THE INVENTION

A cyanoethyl substituted tetraethylene pentamine, referred to as TEPAN in the propulsion industry, is reacted with an ammonium salt to form adducts of TEPAN. TEPAN, which is the reaction product of 2.3 moles of acrylonitrile and one mole of tetraethylenepentamine, has about five amine equivalents present as secondary and a few tertiary amines (confirmed by IR). For a further discussion of TEPAN and its illustrated use refer to U.S. Pat. No. 4,000,023 issued December 1976 to Adolf E. Oberth and Rolf S. Bruenner. Representative ammonium salts are: Ammonium perchlorate (AP), ammonium nitrate (AN), ammonium sulfate (AS), ammonium formate (AF), etc.

Adducts of TEPAN are prepared by adding a distilled water solution of the selected salt, e.g., ammonium sulfate (AS), ammonium formate (AF) or ammonium perchlorate (AP), to TEPAN with stirring and heating, and subsequent evaporation of volatiles. A wide range of ammonium salt to TEPAN ratios may be used. TEPAN/AP adducts having adduct ratios (equivalents of ammonium salt/mole of TEPAN) of 1.0 to 2.0 were made and evaluated. (TEPAN typically has five amine equivalents per mole). TEPAN/AS adducts having adduct ratios of 1.8 to 3.6 were made and evaluated. Several ratios with AF and a combination of AF and AP were made and evaluated.

Various weight percentages of the adducts were added to composite propellant formulations comprised of 88 percent by weight solids, [aluminum (fuel), $Fe_2O_3$ (catalyst), and ammonium perchlorate (oxidizer)] and a binder of hydroxyterminated polybutadiene (R45HT, poly-BD resin, a product of Arco Chemical Company) and dioctyladipate (DOA) cured with a mixture of isophorone diisocyanate (IPDI) and a trifunctional isocyanate (N100).

The amine salt bonding agents of this invention are shown to produce equal or superior physical properties in HTPB composite propellants as compared to the parent compound, with a minimization of in situ ammonia generation.

DESCRIPTION OF THE PREFERRED EMBODIMENT

The amine compound TEPAN, a partially cyanoethylated tetraethylene pentamine, or its glycidol adduct (TEPANOL) is reacted with an ammonium salt to form the adduct of TEPAN or the adduct of TEPANOL and the selected ammonium salt. Representative ammonium salts are: ammonium perchlorate (AP), ammonium nitrate (AN), ammonium sulfate (AS), ammonium formate (AF), etc.

Procedure for Preparation of TEPAN Adduct

The quantities of ammonium salt and TEPAN to give the desired adduct ratio are calculated, and the ammonium salt is dissolved in about five times its weight of distilled water (the quantity of water is not critical). The salt solution is then added slowly to TEPAN with stirring at room temperature. Ammonia is liberated during and for a time after addition of the salt solution, as detected by odor. After approximately one hour at room temperature the mixture is loosely covered and placed in a 70° C.–80° C. oven until evolution of ammonia is complete. Then the adduct solution is transferred to an evaporating dish and dried by initial open exposure in the 70° C.-80° C. oven followed by final drying under vacuum. Many of the adducts tend to pick up water when exposed to ambient laboratory air, so finished adducts are stored in desiccators until used. An alternate method of preparation is to reflux the aqueous solution of ammonium salt and polyamine for 2 to 3 hours and then dry the product in a rotary evaporator.

The adducts ranged in physical form from very viscous liquids to glassy solids which could be crushed. Most of the adducts, when tested, functioned to some extent as bonding agents in propellants. Those with higher amine salt content required a dispersing aid (described later) to function optimally. Candidate bonding agents with adduct ratios of 1.0 to 1.8 equivalents of ammonium salt per mole TEPAN were found to give the best mechanical properties and processing. Control mixes made with TEPAN generated strong ammonia odor. A slight odor of ammonia was detected in the propellant mix when the adduct ratio was 1.0, but not when the ratio was 1.2 or higher; therefore, the preferred range of adduct ratios is between 1.2 and 1.8. The propellant formulation used for evaluating the experimental adducts was comprised of 88% solids (Al, $Fe_2O_3$ and AP) and a binder of hydroxy-terminated polybutadiene (R45HT, Poly-BD resin, a product of ARCO Chemical Company) and dioctyladipate (DOA) cured with a mixture of isophorone diisocyanate (IPDI) and a trifunctional isocyanate (N100). The bonding agents (adducts) of this invention have been evaluated at levels equivalent to 0.15% of unreacted TEPAN based on propellant weight, since TEPAN at that level is an effective bonding agent. The more promising candidates also have been tested at other levels. In these tests the bonding agent was premixed with R45HT and DOA before addition of solid ingredients, although other methods of addition may be used. At the higher adduct ratios it was necessary to add a small quantity of water to the adduct to achieve adequate dispersion in the binder premix. It has been shown that inadequately dispersed adducts gave little or no bonding effect in this type of propellant. Subsequent mixing procedure was standard "state of the art". All propellants were made from the baseline propellant formulation shown below.

In the Summary Data Table III below are listed certain selected properties that are critical to performance or quality control at the temperatures given. The room temperature modulus is commonly used for quality control and strain at −40° C. and tensile strength at +60° C. are critical performance properties. The number after each bonding agent designates its adduct ratio. The codes for the various adducts are identified below.

TC—TEPAN+AP (ammonium perchlorate)

TS—TEPAN+AS (ammonium sulfate)

TF—TEPAN—AF (ammonium formate)

TFC—TEPAN+50/50 equivalents AP and AF

Table I lists the bonding agent identification employed in the experimental work to evaluate the amine salt bonding agent prepared from the polyamine and the ammonium ion donor (AID) salt listed therein. The baseline propellant composition employed to evaluate the bonding agent is set forth in Table II below.

TABLE I

BONDING AGENT IDENTIFICATION

| AMINE SALT BONDING AGENT | AMMONIUM ION DONOR (AID) | EQUIVALENTS AID PER MOLE POLYAMINE | AMINE | NOMINAL UNREACTED AMINE EQUIVALENTS |
|---|---|---|---|---|
| TC-10 | Ammonium Perchlorate | 1.0 | TEPAN | 4.0 |
| TC-12 | Ammonium Perchlorate | 1.2 | TEPAN | 3.8 |
| TC-18 | Ammonium Perchlorate | 1.8 | TEPAN | 3.2 |
| TC-20 | Ammonium Perchlorate | 2.0 | TEPAN | 3.0 |
| TS-18 | Ammonium Sulfate | 1.8 | TEPAN | 3.2 |
| TS-36 | Ammonium Sulfate | 3.6 | TEPAN | 1.4 |
| TF-20 | Ammonium Formate | 2.0 | TEPAN | 3.0 |
| TFC-12 | Ammonium Formate | 0.6 | TEPAN | 3.8 |
| | & Ammonium Perchlorate | 0.6 | TEPAN | |
| TOC 145 | Ammonium Perchlorate | 1.45 | TEPANOL | 3.55 |

TABLE II

BASELINE PROPELLANT COMPOSITION

| | |
|---|---|
| R45HT + IPDI/N100 (56 parts/5 parts) | 9.81-9.61 |
| DOA, Dioctyl adipate | 2% |
| Bonding agent | 0.15-0.35 |
| Al | 18% |
| AP 200/17 | 69% |
| $Fe_2O_3$ | 1% |
| TPB, (Triphenyl bismuth) | 0.02% |
| MA, (Maleic anhydride) | 0.02% |

TABLE III

SUMMARY DATA

| Bonding Agent | BA* | $H_2O$* | Initial Modulus at 25° C. (psi) | Tensile Strength at 60° C. (psi) | Strain at −40° C. at Max. Stress Break, (%) |
|---|---|---|---|---|---|
| 1 None | — | — | 512 | 73 | 16.0/48.9 |
| 2 TEPAN | 0.15 | — | 605 | 82 | 29.6/53.0 |
| 3 TC 1.0 | 0.20 | 0.02 | 582 | 76 | 43.3/60.9 |
| 4 TC 1.2 (lot 119) | 0.21 | — | 551 | 79 | 47.4/61.2 |
| 5 TC 1.2 (lot 1120) | 0.21 | 0.02 | 627 | 84 | 49.8/57.5 |
| 6 TC 1.2 (lot 1120) | 0.21 | 0.03 | 592 | 78 | 51.3/63.9 |
| 7 TC 1.2 (lot 1120) | 0.18 | — | 650 | 87 | 53.3/65.7 |
| 8 TC 1.2 (lot 1120) | 0.24 | — | 661 | 81 | 51.7/63.4 |
| 9 TC 1.2 (lot 1120) | 0.30 | — | 671 | 80 | 51.8/66.3 |
| 10 TC 1.8 (lot 1116) | 0.24 | — | 668 | 84 | 51.7/64.6 |
| 11 TC 1.8 (lot 0) | 0.24 | 0.04 | 552 | 81 | 51.9/57.6 |
| 12 TC 1.8 (lot 0) | 0.30 | 0.04 | 689 | 88 | 48.7/61.6 |
| 13 TC 2.0 | 0.25 | 0.04 | 627 | 84 | 16.9/44.3 |
| 14 TS 1.8 | 0.25 | — | 674 | 84 | 9.8/18.8 |
| 15 TS 1.8 | 0.25 | 0.04 | 605 | 77 | 42.0/44.0 |
| 16 TS 3.6 | 0.35 | 0.04 | 695 | 80 | 11.1/21.9 |
| 17 TS 3.6 | 0.35 | 0.04 | 696 | 81 | 11.0/36.3 |
| 18 TF 2.0 | 0.20 | — | 468 | 58 | 8.4/57.9 |
| 19 TF 2.0 | 0.20 | 0.02 | 525 | 54 | 48.5/61.7 |
| 20 TFC 1.2 | 0.20 | 0.03 | 544 | 78 | 51.8/61.3 |
| 21 TEPANOL | 0.15 | — | 621 | 84 | 43.4/50.3 |

TABLE III-continued

| SUMMARY DATA | | | | | |
|---|---|---|---|---|---|
| Bonding Agent | BA* | $H_2O$* | Initial Modulus at 25° C. (psi) | Tensile Strength at 60° C. (psi) | Strain at −40° C. at Max. Stress Break, (%) |
| 22 TOC-145 | 0.28 | | 646 | 74 | 38.3/51.2 |

*Percent by weight of total propellant composition.
The data of Summary Data Table III shows the following:

1. Mechanical properties, especially strain at maximum stress at −40° C., are substantially improved with the addition of the bonding agent TEPAN (compare samples 1 and 2).

2. Adducts having ratios of ammonium perchlorate to TEPAN from 1.0 to 1.8 function as excellent bonding agents as good as or better than TEPAN. At a 2.0 ratio the −40° C. stress/strain data plot showed maximum stress at low strain, after which stress became slightly regressive indicating the bonding action had begun to lessen at the higher salt level (compare samples 3–13).

have in a like manner as the TEPAN adducts in a propellant composition.

TABLE IV

| ADDITIONS | MIX CYCLES: MIX TIME AFTER ADDITION | VACUUM | TEMPERATURE |
|---|---|---|---|
| R45HT, DOA, BA-premixed | — | No | |
| Al | 10 min | No | 70° C. |
| 200 μAP | * | No | 70° C. |
| ⅓ 17 μAP | 15 min | No | 70° C. |
| ⅓ 17 μAP | 15 min | No | 70° C. |
| ⅓ 17 μAP | 5 min | No | 70° C. |
| | 30 min | Yes | 70° C./54° C. Part A |
| | 60 min | Yes | 70° C./54° C. Part B |
| | 90 min | Yes | 70° C./54° C. Part C |
| | 120 min | Yes | 70° C./54° C. Part D |
| IPDI/N100 + MA + TPB | 15 min | Yes | 54° C. |

Cycle 1 - 30 minutes for processing mixes 1518, 1526, 1530, 1531.
Cycle 2 - 120 minutes for processing mix 1532
Cycle 3 - 60 minutes for all others.

DATA TABLE V

PROCESSING TIME STUDIES
DETECTABLE $NH_3$ RESIDUE AND PHYSICAL PROPERTIES

| MIX NO. & PART | BONDING AGENT | MIX CYCLE | $NH_3$ DETECTED IN CUPS | EOM η 54° C. (KP) | MODULUS AT 25° C. PSI | TENSILE STRENGTH 25° C. PSI | TENSILE STRENGTH 60° C. PSI | % STRAIN, −40° C. MAX STRESS/ BREAK % |
|---|---|---|---|---|---|---|---|---|
| 1518A | 0.24% | 1 | Yes | — | | | | |
| 1518B | TC-12 | | Yes | — | | | | |
| 1518C | | | Yes | — | | | | |
| 1518D | | | No | | | | | |
| 1531A | 0.15% | 1 | Yes | 11.5 | 642 | 94 | 84 | 37.8/47.7 |
| 1531B | TEPEN | | Yes | 10.3 | 642 | 97 | 84 | 37.0/53.0 |
| 1531C | | | Yes | 8.4 | 709 | 107 | 95 | 35.9/48.2 |
| 1531D | | | ? | 7.7 | 696 | 106 | 91 | 37.5/44.5 |
| 1526A | 0.28% | 1 | No | 12.8 | 851 | 106 | 86 | 39.8/51.7 |
| 1526B | TC-18 | | No | 11.5 | 918 | 112 | 94 | 40.4/49.7 |
| 1526C | | | No | 10.5 | 882 | 115 | 93 | 38.5/45.6 |
| 1526D | | | No | 9.5 | 886 | 117 | 96 | 39.1/49.1 |
| 1530A | 0.28% | 1 | No | 8.1 | 500 | 81 | 64 | 40.1/51.6 |
| 1530B | TOC 145 | | No | 9.4 | 585 | 95 | 72 | 39.8/56.8 |
| 1530C | | | No | 8.4 | 646 | 97 | 74 | 38.8/51.2 |
| 1530D | | | No | 9.0 | 626 | 95 | 73 | 39.9/51.3 |
| 1532A | 0.28 | 2 | — | 13.6 | 669 | 95 | 82 | 41.2/51.9 |
| 1532B | TC-18 | | — | 11.6 | 600 | 103 | 91 | 40.6/47.2 |
| 1532C | | | — | 11.0 | 690 | 105 | 90 | 40.0/51.9 |
| 1532D | | | — | 9.0 | 762 | 108 | 95 | 40.0/47.5 |

3. No loss in mechanical properties is observed with any of the TC adducts when small amounts of water are added to some adducts as dispersion aids.

4. Little effect on physical properties is observed with change in concentration of TC 1.2 from 0.18 to 0.30% or of TC 1.8 from 0.24 to 0.30% (compare samples 7, 8 and 9).

5. TS 1.8 functions well as a bonding agent but TS 3.6 does not. TS 1.8 requires water to disperse it so that it can function properly (compare samples 14 and 15 with samples 16 and 17; comparing sample 14 with 15 demonstrates the benefit achieved by employing water as a dispersing aid).

6. TF gives good low temperature strain capability when used with water as a dispersing aid but tensile strength at 60° was comparatively poor (compare samples 18 and 20).

7. TFC 1.2 is a bonding agent essentially equal to TC 1.2 in this propellant with the same amount of added water (compare samples 6 and 20).

8. An amine salt prepared from 1.45 moles AP and 1 mole TEPANOL (TEPAN and glycidol adduct) be-

PROCESSING EVALUATION

From the bonding agent evaluation program three bonding agents were selected for further investigation in the processing-time study. The basic mix cycle for all propellants prepared in this program is outlined in Table IV. For the preliminary screening program the concentration of the candidate bonding agent was adjusted to a basis of 0.15% TEPAN, and cycle 3 was used. This means that the propellant was mixed for 60 minutes between the final addition of 200 AP and beginning addition of the ground AP. Two control mixes were made for reference, one with no bonding agent and one with 0.15% TEPAN.

Cycle 2, 30 minutes mixing between coarse (200μ) AP addition and beginning of fine AP addition, was used in the first half of the processing-time study (See Table V). In the one gallon mixer 3600 g master batches of propellant were mixed according to the standard mix procedure. After vacuum mixing for 30 minutes following the final AP addition a sample was removed from the master batch. Portions of the samples (200 g) of the propellant were placed in 8 ounce polypropylene cups and sealed with a snap on lid. The cups with 200 g samples were turned upside down and placed in a 60° C. oven for 7 days. After the cups were removed from the oven, they were reinverted opened and two people sniffed the 200 g sample as soon as the lid was removed.

The rest of each sample was processed with the appropriate amount of curing agent for 15 minutes in a pint mixer, after which it was cast into a mold for tensile specimens. Another portion was removed after 60 minutes total vacuum mixing time after final AP addition, then again at 90 and 120 minutes. The above procedure was followed for each portion.

Ammonia was detected in all TEPAN samples. Ammonia was detected in all TC-12 samples except the one mixed for 120 minutes after final AP addition. Even though a slight ammonia odor was detected when the unground AP was added to TC-18 and TOC 145 mixes, no ammonia was detected in any of the storage cups. Stabilization of physical properties of the TEPAN propellant did not occur with less than 90 minutes vacuum mixing after AP addition. The length of processing time and extent of effect on physical properties would be greatly dependent on scale size, therefore larger batch sizes would require an even longer vacuum mix cycle to reach this stable physical property plateau. Propellants with TC-18 and TOC 145 had reached their maximum physical properties plateau by the 60 minutes vacuum mix after final AP addition cycle.

The second phase of the processing-time study examined the effect of time interval between coarse AP and ground AP additions (See Table V). TC-18 was selected as the bonding agent of choice based on preceding results. Number 1526 was mixed for 30 minutes between coarse and fine AP addition, 1532 for 120 minutes. There were no significant differences in either viscosity, processibility or physical properties. Each had reached the physical properties plateau by 60 minutes mixing after final AP addition.

ADDITIONAL COMMENTS AND CONCLUSIONS

1. Mechanical properties of composite propellants containing AP are substantially improved, especially at low temperatures, by the bonding agents TEPAN, TEPANOL and certain amine salts made from these polyamines.

2. All amine salts prepared by reacting ammonium perchlorate or ammonium sulfate with the polyamine, up to about 36% of the available amine groups, function as excellent bonding agents. At levels of 40% or more reaction of available amine groups the products do not function as adequate bonding agents under usual process conditions. This is probably due either to inadequate dispersion of the bonding agent or to lack of accessible residual amine groups for chemical bonding to the binder.

3. Bonding agents must be adequately dispersed in the polymer to obtain good low temperature strain properties.

4. No loss in mechanical properties occurred when a small amount of water as a dispersing aid was added to the bonding agent.

5. A dispersing aid was necessary for adequate dispersion of some of the adducts which had relatively high ammonium salt to polyamine ratios.

6. More than 25% of the amine groups in the polyamine must be reacted to minimize ammonia evolution when the amine salt adduct is employed in a propellant composition as a bonding agent.

7. Prereaction of approximately 36% of amine groups in the polyamine appears to be optimum to minimize ammonia evolution and obtain optimum physical properties without the necessity of a dispersing aid.

8. Little or no effect on physical properties or processibility was discernible as a result of the concentration of bonding agent being varied within ranges shown above.

9. Processing time can be greatly reduced with the use of amine salt bonding agents with no loss in propellant mechanical properties or processibility, and without equipment change.

10. Since ammonia evolution is minimized, mechanical property reproducibility may be expected to be increased even with a reduction in mix time.

11. Minimization of ammonia evolution becomes increasingly important with increasing batch size; therefore, this new technology will be most useful in production scale mixes. Reproducibility of properties between mixes should increase while equipment turn-around time and operating man hours should be reduced.

12. No changes in mix procedure or capital equipment are necessary for implementation.

13. Production of the amine salt is an inexpensive and simple step added to preparation of TEPAN for use in propellant.

SUMMARY

Bonding agents can be prepared from polyamines and ammonium compounds. Properly synthesized products are just as effective bonding agents as the parent polyamine, but with several advantages. In situ ammonia generation is minimized and thus processing time can be shortened and reproducibility increased. Thus, the objectives of this invention have been met in that adducts of an amine bonding agent and ammonium salts have been discovered which give no detectable odor of ammonia during the mix and cure cycles, improve the mechanical properties of propellant as much as the parent bonding agent, should improve reproducibility of production scale mixes since ammonia is eliminated.

We claim:

1. In a solid propellant composition employing a high solids loading of an inorganic oxidizer and aluminum metal fuel and a binder system comprised of hydroxy-terminated polybutadiene, a plasticizing agent, a polyisocyanate curing agent, and a bonding agent, the improvement achieved from preventing in situ ammonia generation during the mixing and curing cycles of said propellant composition by employing as said agent a polyamine salt adduct bonding agent wherein said polyamine salt adduct bonding agent functions to minimize in situ ammonia formation, to decrease mixing time for propellant processing, and to increase reproducibility of the mechanical properties in the cured propellant, said polyamine salt adduct bonding agent being an adduct of an ammonium salt selected from the group consisting of ammonia perchlorate, ammonium nitrate, ammonium sulfate, and ammonium formate, and a polyamine compound selected from the group consisting of cyanoethyl substituted tetraethylene pentamine, and the glycidol reaction product of cyanoethyl substituted tetraethylene pentamine, said polyamine salt adduct bonding agent further defined as being the reaction product formed from reacting together said ammonium salt and said polyamine compound in a reaction to produce said polyamine salt adduct bonding agent as a recovered product having from about 25 to about 36 percent of the reactive amine groups of said polyamine compound reacted with the ammonium ion of said ammonium salt.

2. In a solid propellant composition as set forth in claim 1 wherein said polyamine salt adduct bonding agent is further defined as being the reaction product produced by the process which comprises:

(i) dissolving a molar quantity from about 1.0 to about 2.0 of said ammonium salt in about five times its weight of water to form a solution of said ammonium salt;

(ii) slowly adding said ammonium salt solution to said polyamine compound of a molar quantity of about 1.0 while stirring at room temperature;

(iii) reacting said solution and said polyamine compound together for about one hour at room temperature to form a polyamine salt adduct solution while permitting the liberation of ammonia;

(iv) covering loosely said amine polyamine adduct solution after about one hour reaction time and placing same in a 70° C.–80° C. oven to continue said reacting for about three days;

(v) transferring said polyamine salt solution to an evaporating container and drying initially by open exposure in a 70° C.–80° C. oven followed by final drying under vacuum; and (vi) recovering said dried polyamine salt adduct.

3. In a solid propellant composition as set forth in claim 2 wherein said ammonium salt is ammonium perchlorate and wherein said polyamine compound is cyanoethyl substituted tetraethylene pentamine.

4. In a solid propellant composition as set forth in claim 2 wherein said ammonium salt is ammonium nitrate and wherein said polyamine compound is cyanoethyl substituted tetraethylene pentamine.

5. In a solid propellant composition as set forth in claim 2 wherein said ammonium salt is ammonium sulfate and wherein said polyamine compound is cyanoethyl substituted tetraethylene pentamine.

6. In a solid propellant composition as set forth in claim 2 wherein said ammonium salt is ammonium formate and wherein said polyamine compound is cyanoethyl substituted tetraethylene pentamine.

7. In a solid propellant composition as set forth in claim 2 wherein said ammonium salt is ammonium nitrate and wherein said polyamine compound is the glycidol reaction product of cyanoethyl substituted tetraethylene pentamine.

8. In a solid propellant composition as set forth in claim 2 wherein said ammonium salt is ammonium sulfate and wherein said polyamine compound is the glycidol reaction product of cyanoethyl substituted tetraethylene pentamine.

9. In a solid propellant composition as set forth in claim 2 wherein said ammonium salt is ammonium perchlorate and wherein said polyamine compound is the glycidol reaction product of cyanoethyl substituted tetraethylene pentamine.

10. In a solid propellant composition as set forth in claim 2 wherein said ammonium salt is ammonium formate and wherein said polyamine compound is the glycidol reaction product of cyanoethyl substituted tetraethylene pentamine.

* * * * *